US005447207A

United States Patent [19]

Jones

[11] Patent Number: 5,447,207

[45] Date of Patent: Sep. 5, 1995

[54] DOWNHOLE TOOL

[75] Inventor: Dale A. Jones, Houston, Tex.

[73] Assignee: Baroid Technology, Inc., Houston, Tex.

[21] Appl. No.: 168,118

[22] Filed: Dec. 15, 1993

[51] Int. Cl.[6] ..... E21B 17/10

[52] U.S. Cl. ..... 175/325.4; 175/325.7; 166/241.7

[58] Field of Search ..... 175/325.4, 325.6, 325.7, 175/40, 49, 50; 166/241.4, 241.7

[56] References Cited

U.S. PATENT DOCUMENTS

| | | | |
|---|---|---|---|
| 3,680,647 | 8/1972 | Dixon et al. . | |
| 3,818,999 | 6/1974 | Garrett . | |
| 4,106,823 | 8/1978 | Bassinger . | |
| 4,378,852 | 4/1983 | Garrett . | |
| 4,709,462 | 12/1987 | Perkin et al. | 175/325.4 X |
| 4,854,403 | 8/1989 | Ostertag et al. | 175/325.4 |
| 4,879,463 | 11/1989 | Wraight et al. . | |
| 5,120,963 | 6/1992 | Robinson et al. . | |
| 5,134,285 | 7/1992 | Perry et al. . | |

FOREIGN PATENT DOCUMENTS

| | | |
|---|---|---|
| 1177057 | 10/1984 | Canada . |
| 505261A2 | 9/1992 | European Pat. Off. . |

*Primary Examiner*—William P. Neuder
*Attorney, Agent, or Firm*—Browning, Bushman, Anderson & Brookhart

[57] ABSTRACT

A stabilizer-type downhole tool comprises an elongate main body. At least one elongate blade lying generally longitudinally along the exterior of the main body projects radially outwardly therefrom. Attachment means cooperative between the main body and the blade removably retain the blade on the main body so as to permit limited relative longitudinal movement between one end of the blade and the adjacent portion of the main body without necessitating corresponding movement at the other end of the blade. The main body may comprise an instrument-receiving cavity beneath the blade, and an elongate instrument in a sealed housing may be disposed in the cavity, with its ends retained with respect to the adjacent portion of the main body without necessitating corresponding movement at the other end. At least one of the housing ends is so retained as to permit relative longitudinal movement with respect to the main body.

47 Claims, 6 Drawing Sheets

DOWNHOLE TOOL

BACKGROUND OF THE INVENTION

The present invention is applicable to a type of downhole tool that will be referred to herein as a "stabilizer-type" tool. By this is meant an elongate tool having one or more elongate blades running generally lengthwise along its exterior and projecting radially outwardly, usually to the approximate diameter of the borehole in which the tool is to be used. More particularly, the invention pertains to such a tool of the non-rotary type: the blades do not rotate with respect to the tool body. Such a tool may be a stabilizer per se, or it may, for example, be an MWD tool, such as a density tool in which a blade is provided in register with instrumentation that emits and/or receives radiation or other signals running generally radially between the tool and the formation. Certain aspects of the present invention are applicable to such MWD tools, whether or not they are of the stabilizer type, i.e., whether or not they include radially projecting blade(s).

In a non-rotary stabilizer-type tool, the radially outer surfaces of the blades rub against the formation in use. Indeed, it is ordinarily intended that they do so, for one reason or another. In a stabilizer, such contact may be desired for the purpose of centralizing the adjacent portion of the drill string in the hole. A stabilizer, with its hole-contacting blades, may be used as a pivot point for effecting curvature of a borehole in directional drilling or as a stabilizing element to hold an angle. In an MWD tool, such as a density tool, the hole-contacting blades help to prevent substantial variations in the radial distance between the instruments and the borehole wall, and/or to minimize the thickness of any layer of drilling mud or the like that may be interposed between the tool and the formation and that could adversely affect the precision of the measurements taken by the tool.

Even though the outer surfaces of such blades are typically formed of, or reinforced with, a highly wear-resistant material such as tungsten carbide, they still wear in use. After sufficient wear, they no longer properly perform the functions for which they are intended. If, in a stabilizer, the blades are integrally adjoined to the tool body, then a worn stabilizer must be replaced altogether, or else the blades must be re-dressed.

Either alternative is inconvenient, especially in relatively remote or primitive locations. The size and weight of an entire new tool makes it inconvenient to keep significant numbers of replacement tools on hand, so they must be shipped, which is time-consuming and expensive. Blades cannot be readily redressed in the field, so even if the worn tool is to be refurbished, it must be sent to a plant and a replacement shipped out.

For this reason, there have been a number of past attempts to construct stabilizers with removable, and thus replaceable, blades, which allow a basic tool body to be repaired in the field many times. U.S. Pat. Nos. 3,680,647 to Dixon et al., 3,818,999 to Garrett, 4,106,823 to Bassinger, and 4,378,852 to Garrett disclose various schemes for fitting and attaching individual removable blades to stabilizer bodies. Canadian Patent No. 1,177,057 discloses an interesting variation in which each blade is formed in several segments arranged end-to-end, and in which the underside of the blade may be slotted to provide some squeeze-like flexing deep in the pocket in which the blade is received to ensure a tight fit.

A common problem with such removable blade stabilizers is that fretting and the like can cause failure of the screws or other attachment means that fix the blades to the stabilizer body. Roller reamers have elongate, radially projecting rollers that rotate with respect to the tool body and that may also have lateral and/or longitudinal play in their bushings. Roller reamers may serve stabilizer-like functions. However, with respect to non-rotary stabilizers, the conventional wisdom of the art, exemplified by all of the prior patents cited just above, has been to try to cause the blades to fit as snugly as possible within their pockets, and become rigid with the stabilizer body, in order to resist movement relative to the main body of the tool and ingress of drilling fluid into any gaps between the blade and body. However, problems have persisted.

Where an MWD tool is provided with a stabilizer-type blade overlying its instrumentation, it is, of course, all the more desirable for the blade to be removable. This provides access to the instrumentation. Also, blade wear affects calibration of the tool, and with replaceable blades, expensive instruments, and the specialized tool body that go with them, do not have to be disassembled simply because the outer portion of a blade has become worn.

However, it is equally true that the types of problems described above, e.g. loosening and/or loss of blades, can be even more catastrophic in these very expensive MWD tools.

Some blade designs would take up too much of the available radial space in small diameter tools.

If prior art replaceable-blade stabilizer schemes are applied to such tools, then when a worn blade is re-dressed, substantial warpage may occur, requiring substantial corrective machining to return the tool to proper calibration for its instruments.

Similar problems can occur on elongate hatch doors that may be provided for access to the cavities in the tool bodies in which the instruments are disposed even if they do not serve as blades.

U.S. Pat. No. 4,879,463 to Wraight et al. and European Patent Publication No. 0505261A2 disclose such MWD tools with individual blades.

Another scheme is exemplified by U.S. Pat. Nos. 5,134,285 to Perry et al. and 5,120,963 to Robinson et al., in which all three blades are carried on an annular collar that is threaded onto, and concentrically surrounds, the main tool body. Additional problems that may be presented by this last-mentioned scheme include: rotational and/or axial displacement of the collar with respect to the main tool body, which can interfere with proper registering of the blades with the instrumentation; "over-torquing," which can likewise result in misalignment; size and weight of replaceable part; and complications in re-dressing/re-calibration.

Still another problem in these MWD tools is that of protecting the expensive and relatively delicate instrumentation from harmful forces encountered by the tool in which it is carried, and this can be particularly problematic if the instrument is elongated parallel to the length of the tool itself, since that tool will inevitably bend, or at least experience bending forces, in use. Overriding all of this is the need to provide a pressure seal about the instrumentation.

SUMMARY OF THE INVENTION

In accord with the present invention, a new approach is taken to the mounting of non-rotary elongate members, including stabilizer-type blades and instruments, on or in an elongate tool body. The present inventors believe that many of the problems experienced with prior art tools are not merely the result of drilling mud and/or debris insinuating itself between the tool body and the stabilizer blade. The present inventors believe that a substantial factor in prior art failures has to do with the fact that, as a tool is bent or curved along its length and simultaneously rotated in use, a given side of that tool is placed alternately in compression and tension. If an elongate member, such as a non-rotary stabilizer blade or instrument, is attached along that side of the tool body, e.g. by substantially longitudinally spaced apart screws or other attachment means, then these attachment points will be repeatedly pulled away from each other as that side of the tool is placed in tension, then pushed toward each other, as that side of the tool is placed in compression. It is believed that these forces are largely responsible for many of the failures in these attachment means and consequent loosening and/or loss of blades. Forces tending to cause the blades to bend or curve along with the tool body may also play a role.

It can be seen that an instrument hatch cover for an elongate instrument in an MWD tool may be similarly affected by the aforementioned forces, and it can also be seen that the bending forces can be damaging if transmitted through the tool to the instrumentation in the tool cavity.

In accord with the present invention, a member such as a non-rotary stabilizer blade or instrument, which is elongated in the same direction as a tool and which must have its opposite ends mounted to or retained with respect to the tool, has one end so mounted or retained for limited relative longitudinal movement with respect to the adjacent portion of the tool body in a manner that does not necessitate corresponding relative movement at the other end. Thus, the parts of the tool body adjacent the ends of the blade can actually move toward and away from each other, in alternate compression and tension, without the blade and/or its attachment means significantly restraining such movement. By eliminating the resistance to this inevitable movement, the cyclical compression and tension forces are prevented from having their usual damaging effects.

In a preferred stabilizer-type tool according to the present invention, there are attachment means adjacent each end of the blade for removably retaining the blade on a main tool body while permitting such limited relative longitudinal movement between one end of the blade and the main body. From a straight axial position of the tool, the one end of the blade can preferably move in either of two axial directions, relative to the tool body. It is also preferable that the other end of the blade be permitted some limited relative movement with respect to the tool body, though less longitudinal movement than the one end.

In highly preferred forms of the stabilizer tool, the attachment means comprises a respective clamp associated with each end of the blade. Each of the clamps is removably secured to the main tool body, and each clamp and the associate blade end have interengaged longitudinally projecting and receiving formations, such as a tongue and groove, with longitudinal clearance therebetween. There is preferably also radial clearance, and the tongue, preferably carded on the clamp, may be positioned to resiliently urge the associated blade end radially inwardly.

The preferred attachment means further comprises a respective tangential pivot pin pivotally connecting each end of the blade to the main body. The pivot pin at one end may be received in fitted bores in the main body and a longitudinally oversized slot in the blade, to permit the relative longitudinal movement also permitted by the aforementioned clamp. There may likewise be a slight longitudinal oversizing of the blade hole for receipt of the pivot pin at the other end. Thus, these pivot pins help to accommodate the bending forces, without interfering with the longitudinal play permitted by the clamps, and also serve as auxiliary means for preventing loss of the blade in the unlikely event that a clamp should fail or somehow become lost downhole.

In an MWD tool, such a blade preferably overlies, and serves as a cover for, an instrument-receiving cavity in the exterior of the main tool body. An axially elongated instrument disposed in this cavity has a sealed housing with opposite ends removably retained with respect to the main body. At least one end of this housing is preferably so retained in a manner to allow limited longitudinal movement with respect to the adjacent portion of the main body without the necessity for corresponding movement at the other end, with similar advantages to those obtained by the above-described mounting of the blade. Indeed, this mounting technique for the instrument can be used, in accord with the present invention, independently of whether or not any blades are mounted on the tool.

Likewise, the use of a sealed housing mounted removably in the tool, as opposed to instrumentation placed in a sealed tool body hatch, can be used independently of other features of the invention. This last feature helps to prevent bending forces and the like from being transferred through the tool to the instrumentation, and is particularly enhanced if excess space in the cavity is filled with a vibration-dampening substance, such as a viscous grease or an elastomer, that is deformable to fit the space, preventing substantial direct contact between the housing and the tool body. "Vibration-dampening" as used herein does not imply compressibility. The substance need only fill up excess space, while allowing for the relative movements described herein.

A particular advantage to the aforementioned blade arrangement is that, if a blade is worn, it may be removed, redressed, and re-emplaced on the tool body, and shims can be placed beneath it to bring it out to its original radial extent. This same technique of adding or deleting shims can be used to change the effective maximum outer diameter of a tool, for running in different holes or under different conditions.

On the other hand, if blades (or blade-shim combinations) of a uniform radial thickness are always used over the instrument cavity on different diameters of tool, the distance of the underlying instrument from the formation will be the same in all of these tools, the variations being in the diameter of the main tool body or in the other blades.

Known prior art blades cannot readily be shimmed in this manner, and the ability to shim results in many advantages. In addition to maximum versatility and interchangeability of parts as among various tools, if the blade-shim thickness over the instrument is standardized, instrument calibration adjustments are minimized.

The system of the present invention also allows blade size to be minimized. Not only are the small blades lighter and easier to ship and store, but when re-dressed, they are less subject to warpage; thus, it is easier to return the tool to proper calibration.

Various objects, features, and advantages of the invention will be made apparent by the following detailed description, the drawings, and the claims.

DETAILED DESCRIPTION

The figures depict an exemplary embodiment of a non-rotary stabilizer-type density tool according to the present invention. As is well known in the art, a density tool is a type of MWD (measurement while drilling) tool that tests the density of the formation adjacent the borehole in the vicinity of the tool. This is typically done by instrumentation that includes a radiation source, such as a source of gamma rays, disposed so as to emit or project gamma rays generally radially into the formation. At least one, and typically at least two, detectors are provided for detecting the reflections of these gamma rays by the formation. The detections, or readings, are converted by the instrumentation into signals, such as electrical signals, that are transmitted from the instrument up through the drill string to the surface. There, these signals can be converted, by any suitable means as well known in the art, into read-outs that are evaluated to assess and direct the drilling process, and in some cases, to provide data for use in drilling additional wells nearby.

The particular type of density tool illustrated is referred to herein as a stabilizer-type tool because it includes radially projecting blades. Thus, its general external configuration is quite similar to a non-rotary bladed stabilizer.

Figure 1:
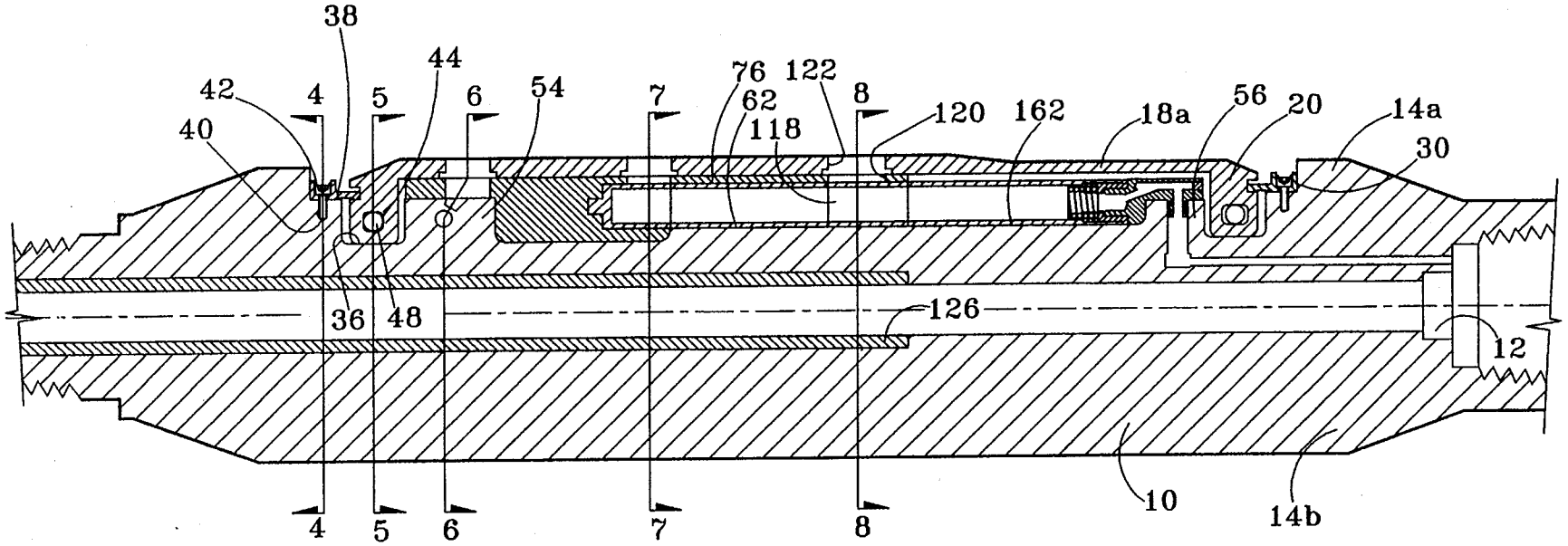
FIG. 1 is a longitudinal cross-sectional view of a stabilizer-type density tool according to the present invention.

With reference now more specifically to the drawings, the tool is elongated, as shown in FIG. 1, for disposition lengthwise in a borehole in use. The tool comprises a main body or tool body 10. Main body 10 would have its opposite ends provided with connection means, such as respective male and female tool joints (not shown) for connecting it into a drill string to form a part thereof. Like other members of the drill string, the body 10 has a central longitudinal bore 12 for circulation of drilling fluid, and in some cases, for passage of other items such as darts or plugs that may be pumped down through the drill string to operate various tools other than the one shown.

As used herein, terms such as "longitudinal," "radial," "circumferential," and "tangential" will refer to dispositions and orientations with respect to the tool body 10, unless otherwise noted. "Tangential" will mean that an item is oriented generally parallel to a tangent in the vicinity in question; however, the item need not be truly tangent to the tool, but can be inset from its periphery, so that it actually lies along a chord. "Up," "down," etc., are used for convenience in a non-limiting sense. For purposes of present discussion, it will be assumed, in this regard, that the part of the tool shown at the right in FIG. 1 is arranged uppermost in the hole in this specific example. However, it should be understood that this tool can be run in a reverse direction.

Tool body 10 has three elongate blade bases 14*a*, 14*b* and 14*c*, formed as integral parts of the tool body itself. The blade bases 14*a*–14*c* are symmetrically circumferentially spaced about the tool body 10, and are elongated parallel to the length of the tool itself. Each of these blade bases 14*a*, 14*b* and 14*c* has a respective, outwardly opening, cavity or pocket 16*a*, 16*b* or 16*c* for receipt of the elongate blades proper, 18*a*, 18*b* and 18*c*, respectively. Cavity 16*a* is deeper, and differently configured, from the other cavities 16*b* and 16*c*, for a purpose to be described more fully below.

The elongate blades 18*a*, 18*b* and 18*c* extend in a true longitudinal direction along the exterior of the tool body 10. However, in other types of tools, such as true stabilizers, the blades may spiral along and across the tool body, in a well-known manner, and will still be considered "generally longitudinally extending" for purposes of this disclosure so long as they have a significant longitudinal component of direction.

Blades 18*a*–18*c* are either formed of, or have their radially outer surfaces coated and/or reinforced with, a highly wear-resistant material, such as tungsten carbide. This is because, due to their radially outward extent, the blades will typically rub against the borehole wall in use. As best shown in the transverse cross-sections, the spaces between the blades allow room for the drilling fluid to flow back up through the annulus.

Each blade has relatively thick or deep (in the radial direction) end portions for non-rotatably mounting the blade to the tool body 10. The mounting portions 20 and 22 for the blades 18*a* are shown in detail, and it should be understood that the other blades 18*b* and 18*c* are similarly mounted. Between its mounting portions 20 and 22, blade 18*a* is undercut, or rendered thinner (radially) from the underside, to enable it to more easily accommodate the bending forces experienced in use. Although blade 18a is undercut more extensively than the other blades, in order to accommodate instrumentation to be described below, the other blades 18*b* and 18*c* are nevertheless undercut intermediate their ends, as may be seen by comparing the transverse cross-sections.

Upper end portion or mounting portion 20 is disposed in a relatively deep upper portion 24 of the cavity 16*a*. It can be seen that there is substantial longitudinal clearance between the mounting portion 20 and the axial end surfaces of cavity portion 24. The axially outer end surface (upper surface in use) of mounting portion 20 has a groove 26 opening axially and widened tangentially, and indeed it may extend all the way across the width of blade 18*a*, so that it opens laterally as well as axially.

Just upwardly of cavity portion 24, tool body 10 has a shoulder 28 that is inset from the outer surface of the tool body, but not as deep as cavity portion 24. More specifically, shoulder 28 is approximately aligned with the radially innermost extremity of groove 26. A clamp 30 has an enlarged head portion 30*a* that is fixed to shoulder 28 by three generally tangentially spaced screws, one of which is shown at 32. If desired, a retainer ring 34 may be interposed in a groove between the head of the screw 32 and the opening in which it is received, to prevent the screw from falling into the borehole in the unlikely event that it would loosen. The clamp 30 also includes a tangentially widened tongue 30*b* that extends axially from the head 30*a* and into the groove 26. Although the clamp 30 is formed of metal, the tongue 30*b* is relatively resilient and is positioned so as to urge the blade 18*a* radially inwardly. The abutting slip surfaces of the tongue 30*b* and groove 26 may be reinforced with wear-resistant insets 31 and 33.

Figure 4:
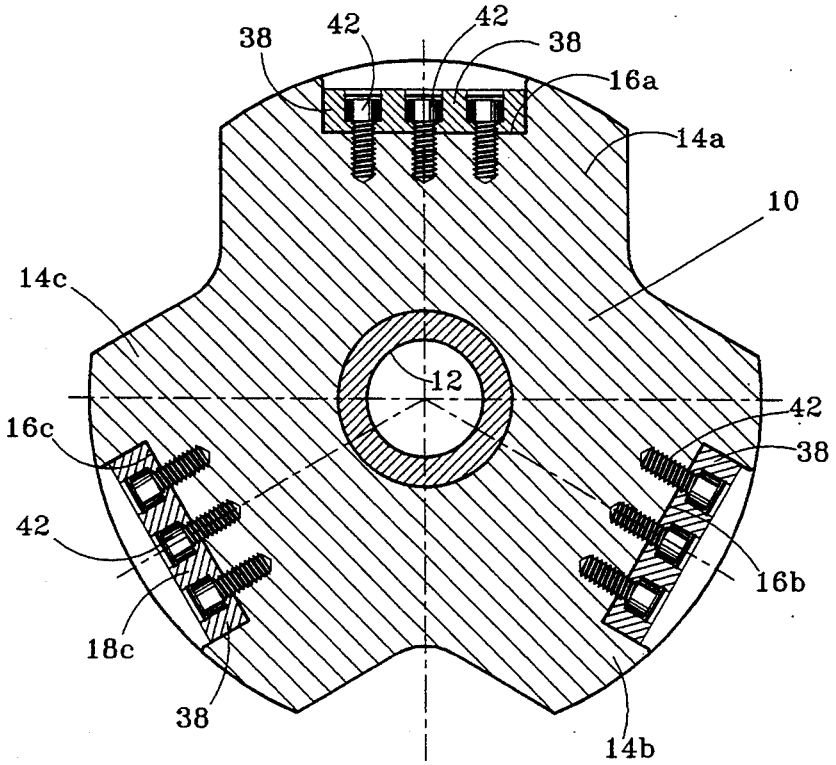
FIG. 4 is a transverse cross-sectional view taken on the line 4—4 of FIG. 1.

The other, or lower, mounting portion 22 of the blade 18*a* is similarly disposed in a relatively deep end portion 36 of the cavity 16*a* and held in place by a clamp 38, identical to and mirror image of clamp 30, which cooperates with a groove 40, mirror image of groove 26. It can be seen that, when the clamps 30 and 38 are in place, there is significant axial clearance between each clamp's tongue and the closed end of the corresponding groove 26 or 40. This, along with the resilience of the clamp tongues, facilitates installation, and after the blade is installed and clamped in place, it can move longitudinally relative to the tool body 10 under force. FIG. 4 shows the tangential widening of the clamp 38 and also shows that the screws 42 that hold it in place are all disposed in the same transverse plane with respect to the axis of the tool, which keeps the bending forces uniform in use. The same arrangement is employed for each set of three screws holding one or another of the various blade clamps in place about the tool body 10.

Figure 5:
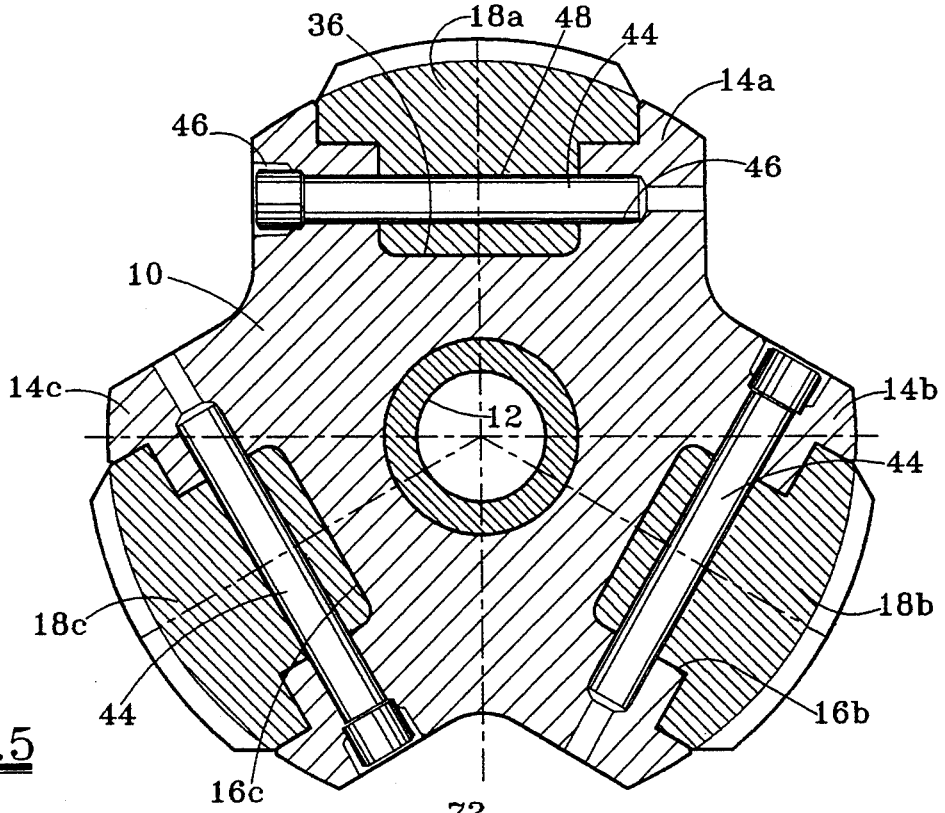
FIG. 5 is a transverse cross-sectional view taken on the line 5—5 of FIG. 1.

The clamps 30 and 38, and the cooperative grooves 26 and 40, form a first subsystem of the attachment means for attaching each blade to the tool body 10. A second subsystem will now be described, referring first to FIGS. 3 and 5 for the lower end of the blade 18*a*. Axially and radially inwardly of the clamp 38, a pivot pin 44 extends tangentially through the mounting portion 36 of the cavity 16*a*. The pin 44 is of round cross-section and is received in fitted bores 46 in the blade base 14*a* on opposite sides of cavity portion 36 and through a hole 48 in mounting portion 22 of the blade. It is desirable for the hole 48 to be slightly radially oversized, and even more longitudinally oversized, with respect to the pivot pin 44, and in order to easily accomplish this, the hole 48 is generally rectangular in cross-section, i.e., transverse to the pin 44 and the hole 48 itself. In reference to FIG. 2, it can be seen that a similar pivot pin 50 is provided at the upper end mounting portion 20 of the blade 18*a*, passing through a rectangular hole 52 therein, but hole 52 is longitudinally oversized with respect to pin 50 to a much greater extent than is the hole 48 as to its pin 44. Like the other pivot pin, pin 50 has its ends received in fitted bores (not shown) in the tool body 10.

When the tool body 10 is in a straight axial position, i.e., when it is not bent along its length, both clamp tongues have clearance with respect to their respective grooves, and the pin 50 has clearance with respect to both ends of the elongated hole or slot 52. Accordingly, if the tool is bent, whether convexly so as to pull clamp 30 away from clamp 38, or concavely, so as to urge the two clamps toward each other, the upper end 20 of blade 18*a* can move in either longitudinal direction, as need be, relative to the tool body 10, without the necessity for corresponding movement at the other end of the blade. This avoids placing high forces on any of the attachment means that connect the blade to the tool body. Both types of bending will occur in use as the tool follows curvatures in the borehole, while simultaneously rotating. Indeed, the tensile and compressive (convexly curving and concavely curving) forces will be imposed in a cyclical manner in the vicinity of the blade 18*a*; but due to the significant longitudinal play permitted at one end of that blade, the attachment means are protected.

A small amount of relative longitudinal movement is also permitted at the lower end 22 of the blade, but more importantly, the oversizing of groove 40 and hole 48 allows pivotal movement of the blade end 22 about pin 44. Of course, such pivotal movement is likewise permitted at the upper end 20 with respect to pin 50. Thus, the pivot pins 48 and 50, while serving as a sort of backup retainer for the blade should the clamps become lost or broken, also cooperate with the resilience of the clamp tongues and the undercutting of the blade itself to help isolate the blade from much of the bending of the attached tool body. The reason more longitudinal play is provided at the top in the example shown is to maintain proper orientation of the windows described below.

Each of the other blades is similarly attached to the tool body, and corresponding parts of the attachment means are denoted by similar reference numerals to those used for the attachment means associated with the blade 18*a*.

As for relative lateral movement between the blades and the tool body, there should be no significant tendency of the blade or attachment means to work back and forth laterally in use. The tool with be rotated in a given direction, which will urge the blade toward one side of the cavity only. In short, it is not believed to contribute substantially to breakage of attachment means or blade loss.

When the outer surfaces of the blades have become worn, the tool can be retrieved, and the blades removed and replaced, without scrapping the entire tool. For convenience in this operation, the pivot pins 48 and 50 are preferably removably installed in the tool body in any suitable manner. It can be appreciated that there are numerous types of tools, including otherwise conventional stabilizers that do not incorporate density instrumentation, which can advantageously utilize the above-described attachment means and other blade-related features of the present invention.

When the blades are incorporated in a density tool, as shown, the reason for providing a blade that extends close to the borehole wall is typically to minimize the thickness of any layer of drilling mud interposed between the borehole wall and the periphery of the tool in the vicinity of the density instrumentation. Thus, in the density tool, at least one blade preferably overlies the density instrumentation. As previously mentioned, the cavity 16*a*, which receives blade 18*a*, is more deeply and intricately formed than are the cavities for the other blades, and the reason is that the cavity 16*a* also serves to receive the density instrumentation.

Figure 3:
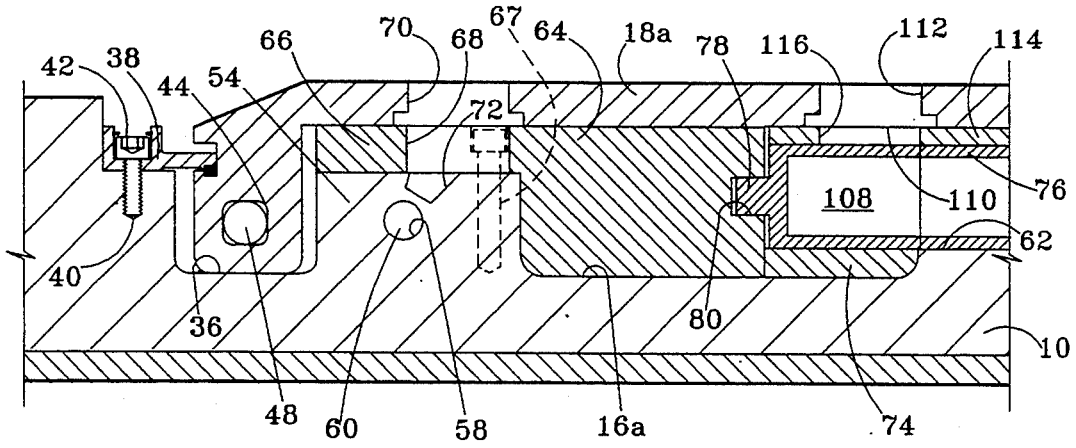
FIG. 3 is an enlarged detailed view of the area in the phantom circle at the left of FIG. 1.
Figure 6:
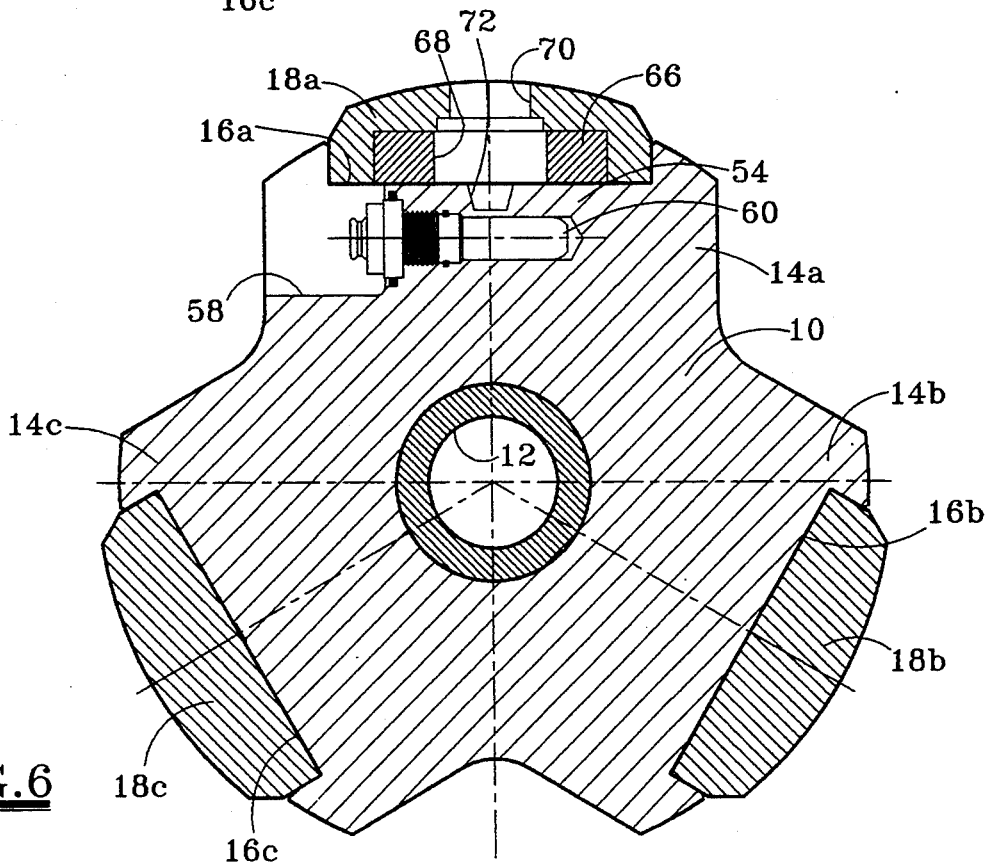
FIG. 6 is a transverse cross-sectional view taken on the line 6—6 of FIG. 1.
Figure 7:
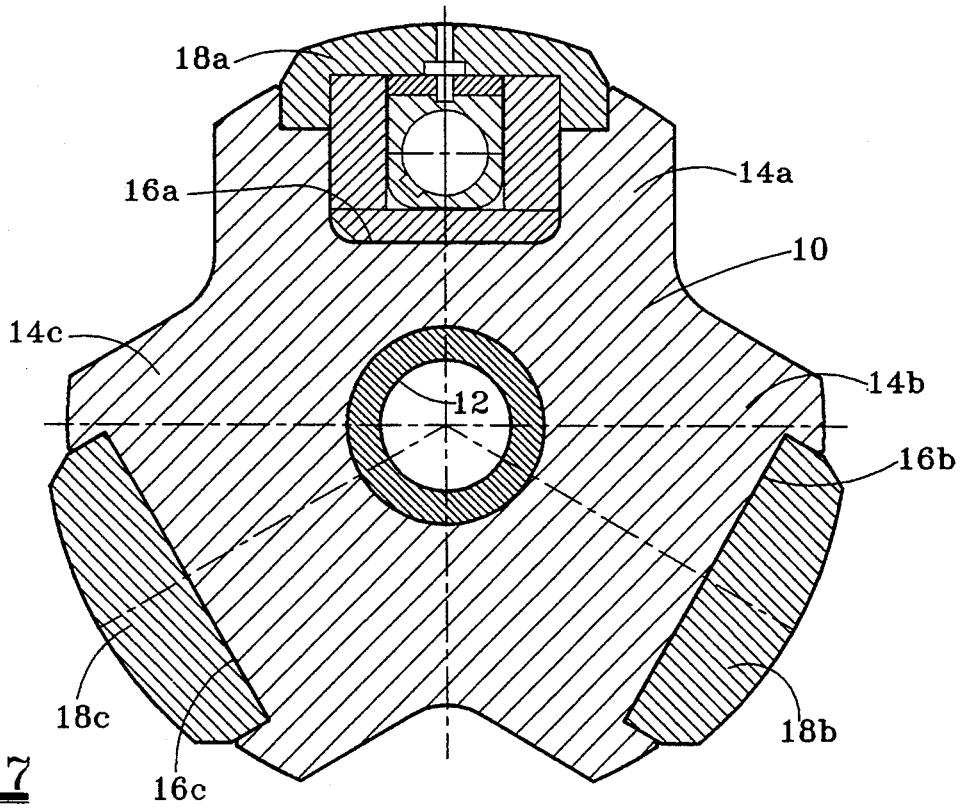
FIG. 7 is a transverse cross-sectional view taken on the line 7—7 of FIG. 1.

In the bottom of cavity 16*a*, the tool body forms two shallow ridges 54 and 56, just axially inwardly of the cavity portions 24 and 36 that receive the ends of the blade 18*a*. As best seen in FIGS. 3 and 6, the blade base 14*a* has a bore 58 extending laterally into the ridge 54 from one side. A radiation source 60 is installed in the bore 58, which may be counterbored, partially threaded, and otherwise configured to properly receive and cooperate with the radiation source 60 and associated parts such as seal(s) and/or retainer(s). These are not described in detail as they are known in the art. Source 60 may be of any type well known in the art for emitting gamma rays to test the density of the formation surrounding the borehole and will therefore not be described in detail. It is noted, however, that the outermost end of source 60 is preferably sealed with respect to bore 58. Downhole pressure helps to hold the source in place. However, suitable means, such as threads, may be used to removably retain source 60 in bore 58.

Between ridges 54 and 56 lies a long and relatively deep portion of cavity 14*a*, generally designed to receive the radiation-detection instrumentation. The lower end of this central cavity portion 62 is deeper than the remainder and specifically may be approximately as deep as the mounting portions 36 and 24 of the cavity. A tungsten mounting bracket 64 is fitted into this deep lower end of cavity portion 62 and has a flange 66 that extends downwardly over the radially outer surface of the ridge 54. Bracket 64 is bolted in place, as indicated at 67. The bracket 64 not only serves as a means for mounting one end of the detection equipment, as will be described below, but also provides tungsten radiation shielding between the source 60 and the near detector.

Flange 66 has a radiation-transparent window 68, as known in the art, aligned along the desired path P of gamma rays from source 60 into the formation. For simplicity of illustration, window 68 is simply shown as a hole. However, as known in the art, the window area may actually be filled with a solid, but effectively radiation-transparent, substance. Blade 18*a* also has such a window 70 aligned along the path P. Also, a recess 72 may be provided in ridge 54 on the path P so as to minimize the amount of tool body material through which the radiation must pass in the desired direction.

As best seen in FIG. 3, the mounting bracket 64 does not fill the entire length of the enlarged lower end of cavity portion 62. A tungsten shield piece 74 is placed in the bottom of that enlarged cavity portion, longitudinally upwardly from bracket 64. The shield piece 74 has its thickness chosen so that, when properly seated as shown, its radially outer surface is generally aligned with that of the remainder (upper part) of the cavity portion 62, so that it forms a continuation thereof.

The radiation-detection instrumentation is housed in an elongate, tubular, pressure-sealed housing 76 sized to be removably received in cavity portion 62. At its lower end, housing 76 has a longitudinally projecting stub 78 that is received in an axial socket 80 in the mounting bracket 64. Socket 80 is slightly laterally oversized and significantly longitudinally oversized with respect to stub 78. Since bracket 64 is bolted in place, it serves as a means for retaining housing 68, via its stub 78, with respect to the tool body 10, while permitting significant relative longitudinal movement between the lower end of housing 76 and the adjacent portion of the tool body 10 by virtue of the longitudinal clearance between stub 78 and socket 80 and the adjacent shoulders. Corresponding movement at the other end of the housing is not necessitated. This achieves much the same result as the above-described mounting of the blade 18*a* in that, even though both ends of housing 76 are retained with respect to the tool body, if the portions of the tool body adjacent those housing ends move cyclically toward and away from each other under alternate compressive and tensile loading, these loads need not be harmfully transferred to the housing 76 and/or any means interconnecting the housing 76 and the tool body. The slight lateral oversizing of socket 80 with respect to stub 78 also permits a certain degree of canting of the housing 76 with respect to the mounting bracket 64, thereby to better accommodate bending forces without harm to the housing 76.

Figure 2:
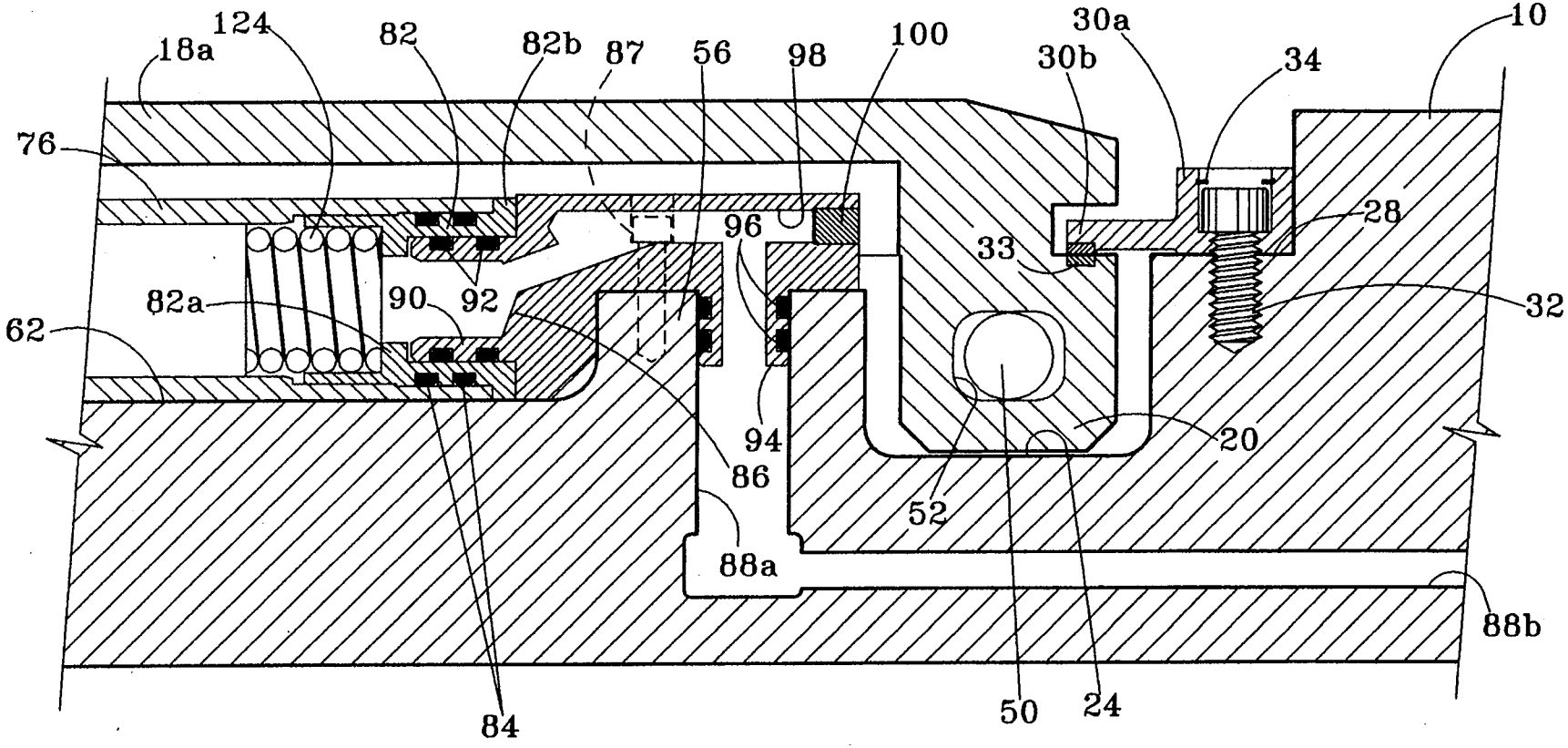
FIG. 2 is an enlarged detailed view of the area in the phantom circle at the right of FIG. 1.

As shown in FIG. 2, the upper end of the housing 76 is retained with respect to the tool body 10. The upper end of housing 76 is axially open, and co-axially receives a nut 82. The nut 82 has an in-turned flange 82*a* at its lower end and an out-turned flange 82*b* at its upper end. The intermediate tubular portion of the nut 82 is sealed with respect to the surrounding housing 76 by a pair of O-rings 84. A mounting bracket 86 is bolted in place as indicate at 87. Bracket 86 communicatively connects the upper end of housing 76 to the ridge 56, which has a wire passage with a lateral run 88*a* and a longitudinal run 88*b* extending upwardly and communicating with other passageways in the drill string above the density tool to carry signals to appropriate instruments or other devices known in the art.

The mounting bracket 86 includes a tubular downward projection 90 that fits into the interior of nut 82 and is sealed with respect thereto by O-rings 92. Above the tubular portion 90, bracket 86 widens to form a shoulder overlying the upper flange 82*b* of the nut 82. The portion of bracket 86 above that shoulder is configured to mate with the end surface of cavity portion 62, following thence across the ridge 56, as shown. Another tubular projection 94 of bracket 86 fits into lateral wire passageway run 88*a* and is sealed with respect thereto by a pair of O-rings 96.

A wire passageway 98 runs through bracket 86 intercommunicating the tubular projections 90 and 94. An axially upper opening used in formation of this passageway may be plugged as indicated at 100. Although the main slip joint of the housing 76 with respect to the tool body is formed by the stub 78 and its socket 80, there may also be some limited longitudinal play and pivoting permitted between mounting bracket 86 and the upper end of housing 76.

Within housing 76 are a near-detector assemblage and a far-detector assemblage. In reference to FIG. 3, the near-detector assemblage, which is known in the art and therefore not shown in detail, is so called because it is closest to the radiation source 60. It includes, at its lowermost end, a near detector 108 that is aligned with a thin zone 110 of housing 76, as well as a radiation-transparent window 112 in the blade 18*a*. An outer radiation shield 114 of tungsten is emplaced between the blade 18*a* and the housing 76 in alignment with the area from the lower end of the housing 76 to the upper end of the far detector, to be described below, and this shield also has a radiation-transparent window 116 in alignment with window 112. Just above detector 108 is other apparatus such as means for producing electrical signals indicative of the radiation detected by detector 108.

Likewise, a far-radiation detector 118 is aligned with a thin portion of housing 76 and windows 120 and 122 in the shield 114 and blade 18*a*, respectively. Detector 118 is also associated with apparatus in the housing 76 for producing electrical signals indicative of the radiation detected by detector 118.

With reference again to FIG. 2, a compression-type helical spring 124 is interposed between the flange 82*a* and the top of the instrument stack to properly compressively load the instrumentation within housing 76. Wires (not shown) carrying the electrical signals produced may pass out through the center of spring 124 into the passageway 98.

The central bore 12 of the tool body is counterbored in the area of the detectors and source, and in this counterbore is fitted a tubular, tungsten radiation shield 126.

The fit of housing 76 in cavity portion 62 is preferably loose. This facilitates assembly and prevents excessive forces from being transferred through the tool to the housing—and possibly interfering with, or damaging, the instrumentation therein—by providing clearance. Because the housing 76 is self-sealed, there is no need to form a seal between the blade 18*a* and the cavity 16*a*, even though the blade 18*a*, in effect, serves as a cover for the cavity. Only small bracket 86 need be sealed to the housing 76 and the tool body. However, in order to dampen any harmful vibrations, excess space in the cavity and the opposed undercut area of blade 18*a* is preferably filled with a deformable, vibration-dampening substance. Although one or more elastomeric bodies may be provided to fill at least some of this space, a convenient way of completely filling the space is to simply inject a viscous fluid, such as a suitable grease-like substance. Such a substance can virtually surround the housing 76. This prevents substantial (large area) direct contact between housing 76 and the tool body; the only possible direct contact is at the end mountings.

Figure 8:
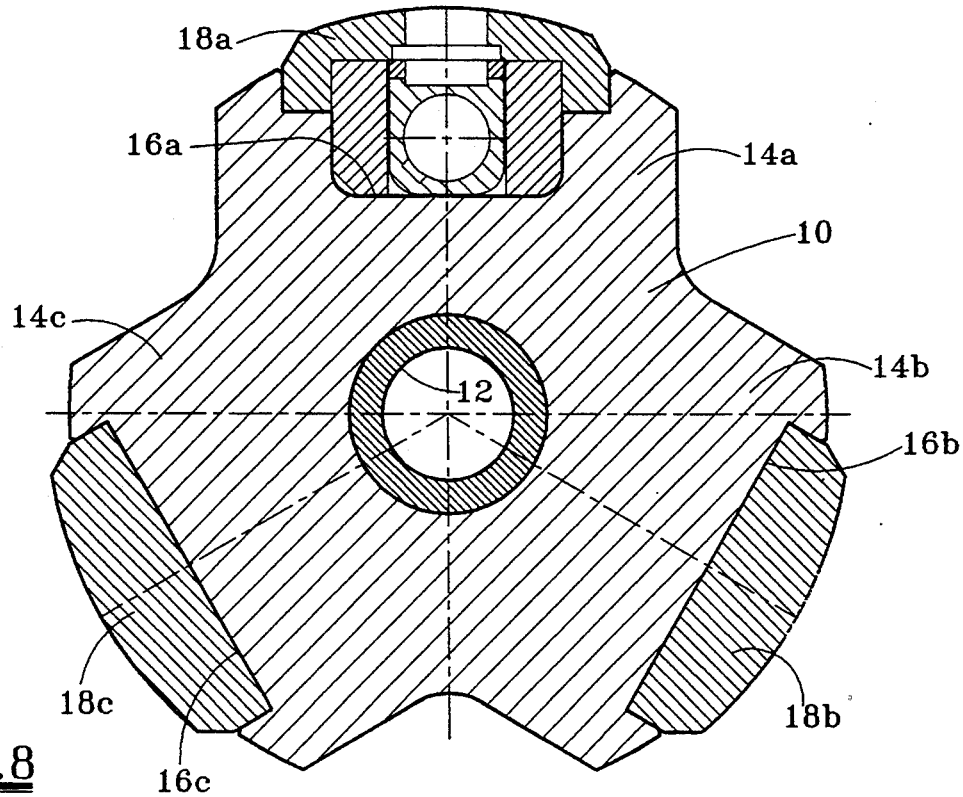
FIG. 8 is a transverse cross-sectional view taken on the line 8—8 of FIG. 1.
Figure 9:
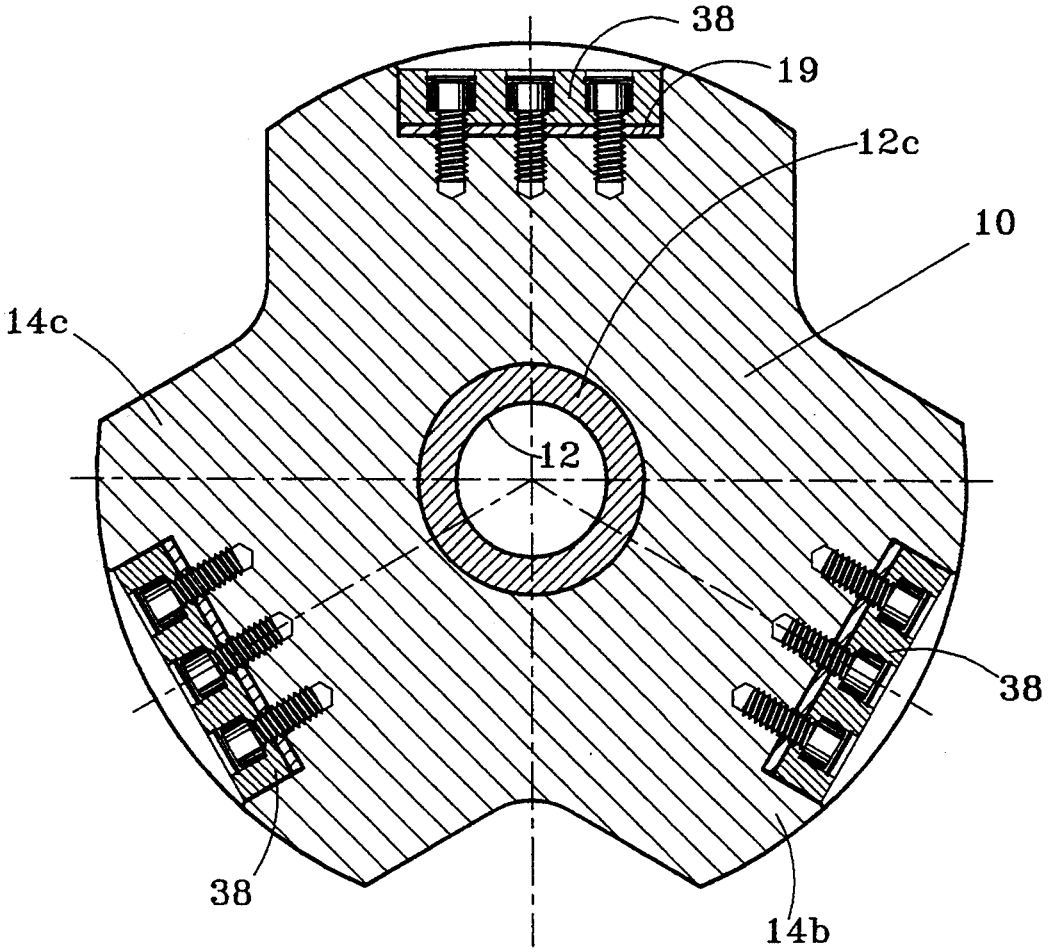
FIG. 9 is a view similar to that of FIG. 4, but showing the use of shims between the blades and tool body.

FIG. 8 shows how shims 19 can be interposed between the thick mounting ends of the blades and the bottoms of the corresponding portions of the cavities to vary the radial extent of the blades from the tool body. Placing and removing such shims can achieve a number of different functions. If blades have become worn, then after they are re-dressed (which will necessarily involve some thinning), they can be used with shims to bring them back out to their original radial extent. A tool may be initially provided with shims, which can be removed if it should be desired to run the tool under gauge. In the latter situation, it is preferable to remove shims only from beneath those blades that do not overlie the instrumentation, so as not to upset the calibration of the instrumentation. Of course, when a blade has been redressed, and is therefore used over the instrumentation with shims, some re-calibration will be necessary, but this should be minimized.

In some systems, it may be desirable to use shims to increase or decrease the effective diameter, particularly if the tool is a simple stabilizer, rather than a density tool or other MWD tool.

If this means is used to vary the tool diameter in an MWD tool, it may be preferable to effect the variations only on those blades that do not overlie instrumentation, for reasons already mentioned. On the other hand, in density tools and the like, a standard blade thickness might be used for tools of various diameters, the variation in diameter being effected by the tool body, so that calibration differences from tool to tool are minimized. In this case, the standardized blade thickness might be initially achieved by blades alone, or by blade and shim combinations, depending upon what other uses are to be made of the shims later on. The above are examples only, and other versatile advantages of the ability to shim the blades may suggest themselves to those of skill in the art.

Numerous variations to the above-described exemplary embodiment may suggest themselves to those of skill in the art. For example, various aspects of the invention may be applied to MWD tools other than density tools, and, of course, those aspects of the invention relating to the blade mountings can be applied to any non-rotary stabilizer-type tool. By way of particular example, it has been explained above that, in a density tool as shown in the exemplary embodiment, there is a particular advantage to allowing more longitudinal play at one end of the blade than at the other. However, in other types of tools, most notably ordinary stabilizers, the pivot formations, etc., at the two ends of the blade could be identical, allowing identical amounts of longitudinal play. Accordingly, it is intended that the invention be limited only by the claims that follow.

What is claimed is:

1. A stabilizer-type downhole tool comprising:

an elongate main body;

at least one non-rotary elongate blade lying generally longitudinally along the exterior of the main body and projecting radially outwardly therefrom; and attachment means cooperative between the main body and the blade to removably retain the blade on the main body while permitting limited relative longitudinal movement between one end of the blade and the adjacent portion of the main body without necessitating corresponding relative movement at the other end of the blade.

2. The apparatus of claim 1 wherein the tool has a straight-axial position from which the one end of the blade can move relative to the main body in either of two axial directions.

3. The apparatus of claim 2 wherein the attachment means is adapted to permit limited relative movement between each end of the blade and the main body.

4. The apparatus of claim 1 wherein the blade is undercut along a major portion of its length between its ends.

5. The apparatus of claim 1 further comprising a plurality of such blades circumferentially spaced about the main body.

6. The apparatus of claim 1 wherein the blade overlies an instrument-receiving cavity in the main body.

7. The apparatus of claim 6 further comprising shim means interposed between the blade and the main body.

8. A stabilizer-type downhole tool comprising:

an elongate main body;

at least one non-rotary elongate blade lying generally longitudinally along the exterior of the main body and projecting radially outwardly therefrom; and attachment means cooperative between the main body and the blade to removably retain the blade on the main body, the tool having a straight axial position, and the attachment means being operative to permit limited relative longitudinal movement in either of two axial directions between one end of the blade and the adjacent portion of the main body without necessitating corresponding relative movement at the other end of the blade, and the attachment means further being adapted to permit pivotal movement of each end of the blade about a respective tangential axis.

9. The apparatus of claim 8 being a density tool, and wherein any relative longitudinal movement permitted between the other end of the blade and the respective adjacent portion of the main body is more limited than that of the one end of the blade.

10. A stabilizer-type downhole tool comprising:

an elongate main body;

at least one non-rotary elongate blade lying generally longitudinally along the exterior of the main body and projecting radially outwardly therefrom; and attachment means cooperative between the main body and the blade to removably retain the blade on the main body while permitting limited relative longitudinal movement between one end of the blade and the adjacent portion of the main body without necessitating corresponding relative movement at the other end of the blade, the attachment means comprising a respective clamp associated with each end of the blade, each clamp being removably secured to the main body, and each clamp and the associated blade end having interengaged longitudinally projecting and receiving formations with longitudinal clearance therebetween.

11. The apparatus of claim 10 wherein each clamp comprises a longitudinally extending, resilient tongue positioned to resiliently urge the associated blade end radially inwardly.

12. The apparatus of claim 11 wherein the tongue is received in an oversized groove in the associated end of the blade.

13. The apparatus of claim 12 wherein each tongue and the respective groove have abutting slip surfaces reinforced with wear-resistant material.

14. The apparatus of claim 11 wherein each clamp and its tongue are tangentially widened, each clamp being so secured by a plurality of radial pins having axes in the same transverse plane.

15. The apparatus of claim 10 wherein the attachment means further comprises a respective tangential pivot pin pivotally connecting each end of the blade to the main body; the pivot pin at the one end of the blade being relatively longitudinally movable with respect to either the blade or the main body.

16. The apparatus of claim 15 wherein the pivot pin at the one end of the blade is received in fitted bores in the main body and a substantially longitudinally oversized slot in the blade.

17. The apparatus of claim 16 wherein the slot in the one end of the blade is generally rectangular in section transverse to the respective pin; the pivot pin at the other end of the blade being received in fitted bores in the main body and a hole in the blade, the hole being generally rectangular in section transverse to the respective pin.

18. The apparatus of claim 17 wherein the rectangular hole in the other end of the blade is slightly longitudinally oversized with respect to the respective pivot pin.

19. The apparatus of claim 15 wherein the blade is undercut along a major portion of its length between its ends.

20. A stabilizer-type downhole tool comprising:

an elongate main body;

at least one non-rotary elongate blade lying generally longitudinally along the exterior of the main body and projecting radially outwardly therefrom;

and attachment means cooperative between the main body and the blade to removably retain the blade on the main body while permitting limited relative longitudinal movement between one end of the blade and the adjacent portion of the main body without necessitating corresponding relative movement at the other end of the blade, the attachment means comprising a respective pivot pin pivotally connecting each end of the blade to the main body, the pivot pin at the one end being relatively longitudinally movable with respect to either the blade or the main body.

21. A stabilizer-type downhole tool comprising:

an elongate main body;

a plurality of elongate blades lying generally longitudinally along the exterior of the main body, projecting radially outwardly therefrom, and circumferentially spaced from one another about the main body, one of the blades overlying an instrument-receiving cavity in the main body;

attachment means cooperative between the main body and the one blade to removably retain the one blade on the main body while permitting limited relative longitudinal movement between one end of the one blade and the adjacent portion of the main body without necessitating corresponding relative movement at the other end of the one blade;

and an elongate instrument housing removably disposed in the cavity, the housing having opposite ends retained with respect to the main body, one end of the housing being so retained in a manner permitting limited longitudinal movement thereof with respect to the adjacent portion of the main body without necessitating corresponding relative movement at the other end of the housing.

22. The apparatus of claim 21 wherein said instrument housing contains radiation-detecting means.

23. The apparatus of claim 22 further comprising a radiation source overlain by said blade, said tool being an MWD density tool.

24. The apparatus of claim 23 further comprising a plurality of such blades circumferentially spaced about the main body, and shim means radially interposed between the main body and blades that do not overlie the cavity.

25. The apparatus of claim 21 wherein excess space in the cavity is filled with a deformable, vibration-dampening substance.

26. The apparatus of claim 25 wherein said vibration-dampening substance generally surrounds the housing, preventing substantial direct contact between the housing and the main body.

27. The apparatus of claim 21 wherein the housing is sealed.

28. The apparatus of claim 21 further comprising shim means radially interposed between the blade and the main body.

29. A downhole MWD tool comprising:

an elongate tool body having a cavity in an exterior surface thereof;

an instrument elongated in the same direction as the tool body and comprising an elongate housing removably disposed in the cavity and having opposite ends retained with respect to the tool body, one end of the instrument housing being so retained to the tool body as to permit limited longitudinal movement of the one end with respect to the adjacent portion of the tool body without necessitating corresponding relative movement at the other end of the housing; and a cover overlying, but not sealing the cavity.

30. A downhole MWD tool comprising:

an elongate tool body having a cavity in an exterior surface thereof;

an instrument elongated in the same direction as the tool body and comprising an elongate housing removably disposed in the cavity and having opposite ends retained with respect to the tool body, one end of the instrument housing being so retained to the tool body as to permit limited longitudinal movement of the one end with respect to the adjacent portion of the tool body without necessitating corresponding relative movement at the other end of the housing by means of one mounting member at one end of the cavity, the one end of the instrument housing and the one mounting member having slidable longitudinally projecting and receiving formations; and a cover overlying the cavity.

31. The apparatus of claim 20 wherein the projecting and receiving formations have sufficient lateral clearance to permit limited canting of the instrument housing with respect to the tool body.

32. The apparatus of claim 20 further comprising another mounting member at the other end of the cavity, connecting the other end of the instrument housing to the tool body, and adapted to provide signal communication between the instrument and the interior of the tool body.

33. The apparatus of claim 30 wherein excess space in the cavity is filled with a deformable, vibration-dampening substance.

34. The apparatus of claim 33 wherein the vibration-dampening substance generally surrounds the housing, preventing substantial direct contact between the housing and the tool body.

35. The apparatus of claim 33 wherein the housing is sealed.

36. The apparatus of claim 30 wherein the instrument comprises radiation-detection means.

37. The apparatus of claim 36 wherein said tool is a density tool, and further comprises a radiation source.

38. The apparatus of claim 30 wherein the cover comprises an elongate blade removably mounted on and projecting radially from the tool body.

39. The apparatus of claim 38 further comprising additional removable blades circumferentially spaced about the tool body.

40. The apparatus of claim 38 further comprising shim means radially interposed between the additional blades and the tool body.

41. A downhole MWD tool comprising:

an elongate tool body having a cavity in an exterior surface thereof;

an instrument elongated in the same direction as the tool body and comprising an elongate housing removably disposed in the cavity and having opposite ends retained with respect to the tool body, one end of the instrument housing being so retained to the tool body as to permit limited longitudinal movement of the one end with respect to the adjacent portion of the tool body without necessitating corresponding relative movement at the other end of the housing; and a cover overlying the cavity, the cover being mounted for limited relative movement with respect to the tool body.

42. The apparatus of claim 41 wherein the cover comprises an elongate blade projecting radially from the tool body.

43. The apparatus of claim 42 further comprising shim means radially interposed between the blade and the tool body.

44. A downhole MWD tool comprising:

an elongate tool body having a cavity in an exterior surface thereof;

a pressure-sealed instrument housing, elongated in the same direction as the tool body, removably disposed in the cavity with clearance therebetween; and a cover overlying, but not sealing the cavity.

45. The apparatus of claim 44 wherein the cover is an elongate blade projecting radially from the tool body.

46. The apparatus of claim 44 comprising means establishing signal communication between the interior of the housing and the interior of the tool body.

47. The apparatus of claim 44 wherein the clearance in the cavity is filled with a deformable vibration-dampening substance.

* * * * *

UNITED STATES PATENT AND TRADEMARK OFFICE

CERTIFICATE OF CORRECTION

PATENT NO. : 5,447,207

DATED : September 5, 1995

INVENTOR(S) : Dale A. Jones

It is certified that error appears in the above-indentified patent and that said Letters Patent is hereby corrected as shown below:

In column 15, line 24, delete "20" and insert therefor --30--.
In column 15, line 29, delete "20" and insert therefor --30--.

Signed and Sealed this

Twenty-first Day of November, 1995

Bruce Lehman

*Attest:*

BRUCE LEHMAN

*Attesting Officer*

*Commissioner of Patents and Trademarks*